United States Patent [19]

Tawil

[11] 4,356,899

[45] Nov. 2, 1982

[54] ATTACHE CASE INCLUDING EXPANSION GUSSET

[75] Inventor: Abraham I. Tawil, Brooklyn, N.Y.

[73] Assignee: H.I.T. Industries, Ltd., Avenel, N.J.

[21] Appl. No.: 198,655

[22] Filed: Oct. 20, 1980

[51] Int. Cl.[3] ..... A45C 3/02; A45C 7/00

[52] U.S. Cl. ..... 190/44; 150/1.6

[58] Field of Search ..... 190/44, 45, 21, 50, 190/22, 14, 54, 58 A, 58 B, 58 R, 41 R; 150/1.6, 30, 1.7; 220/4 R, 7, 8; 229/DIG. 3

[56] References Cited

U.S. PATENT DOCUMENTS

| | | | |
|---|---|---|---|
| 1,341,099 | 5/1920 | Abramson | 190/44 |
| 2,002,878 | 5/1935 | Belber | 190/44 |
| 2,555,820 | 6/1951 | Satz | 150/1.6 |
| 3,523,596 | 8/1970 | Dyke | 190/44 |

*Primary Examiner*—William Price
*Assistant Examiner*—Sue A. Weaver
*Attorney, Agent, or Firm*—Weinstein & Sutton

[57] ABSTRACT

The invention provides an attache case having an expansion gusset and improved fastening arrangements for opening and closing the expansion gusset. These include releasable snap fasteners, straps with slack sections or elastic sections, or elastic members overlapping the interior of the expansion gusset.

7 Claims, 10 Drawing Figures

ATTACHE CASE INCLUDING EXPANSION GUSSET

BACKGROUND OF THE INVENTION

The invention relates to attache cases and, more particularly, to an attache case including an expansion gusset for expanding the capacity of the attache case when needed.

Typically, such attache cases include first and second relatively movable sections or compartments, with at least one of the sections including an expansion gusset for expanding the capacity of the attache case. As is well known, the expansion gusset is movable between a closed position and an expanded position, and to move the expansion gusset to its expanded position, it can be done manually, or by squeezing enough contents into the attache case so that it is forced to automatically expand to its expanded position.

Referring to FIG. 1, there is shown a typical prior art arrangement of an attache case including fastening means for releasably maintaining the expansion gusset in its closed position. As will be noted, the attache case 10 includes first and second sections 12, 14 relatively movable with respect to each other for opening and closing the case. The expansion gusset 16 is shown located in movable section 14 and includes a vinyl strip 16*a* facing the exterior of the case and is covered on the interior of the case by liner 14*a*. The gusset 16 is held in its closed position by fastening means 18. Usually there are four such fastening means 18 disposed on the sidewalls 14*a* of the case. Such prior art fastening means 18 typically include a strap 20 having fixed fastening means 22 at one end thereof on one side of the expansion gusset 16, and releasable fastening means 24 on the other end of the strap 20 on the other side of the expansion gusset 16. As shown in exploded form, fixed fastening means 22 includes plate 22*a* and screws 22*b*. In operation, when it is desired to increase the capacity of the attache case, snap fasteners 24 are released, and the expansion gusset 16 is moved to its expanded position. Manual release of the snap fasteners 24 is usually satisfactory and does not damage the attache case.

However, when a force is applied to the fastening means 18 to automatically release the fastening means and to move the expansion gusset 16 to its expanded position, problems are created. More particularly, when the attache case becomes overstuffed, so that the expansion gusset 16 must move into its expanded position, a force is applied to fastening means 18 in the vertical direction of the strap 20, and such vertically-acting force will eventually cause the snap fasteners 24 to be released. However, it should be understood that a great deal of force is required in the direction of the strap 20 to release the snap fasteners 24, since the direction of force necessary to release the snap fasteners 24 is in a direction perpendicular to the sidewall 14*a* of the attache case. Accordingly, an undue vertically-directed force is applied along the strap 20 until it finally develops a sufficient component of force in the axial direction of the snap fasteners 24 to release the snap fasteners. However, it should be clear that until the snap fasteners 24 are finally released, a great deal of force is applied to the fixed fasteners 22. It has been experienced that over a period of continued use, the fixed fasteners 22 continually weaken as a result of the large force being applied thereto until the snap fasteners 24 are released. As a result, in many cases, the strap 20 eventually rips off the fixed fastener 22.

Broadly, it is an object of the present invention to provide an improved arrangement for releasing the expansion gusset into its expanded position which overcomes one or more of the aforesaid drawbacks. Specifically, it is within the contemplation of the present invention to provide an improved fastening device which is inexpensive, easy to employ, and which is not subject to undue forces and stresses to weaken the fastening device.

SUMMARY OF THE INVENTION

Briefly, in accordance with the principles of the present invention, there is provided an improved fastening arrangement for the expansion gusset of an attache case. More particularly, the attache case includes first and second sections or compartments relatively movable with respect to each other for opening and closing the attache case. At least one of the first and second sections includes an expansion gusset for expanding the capacity of the attache case, with the expansion gusset being movable between a closed position and an expanded position. In one embodiment, fastening means are provided for releasably maintaining the expansion gusset in the closed position, with the fastening means including a strap having a first snap fastener on a first side of the expansion gusset and a second snap fastener on the other side of the expansion gusset, so that at least one of the snap fasteners is released when the expansion gusset moves to its expanded position.

In a still further embodiment, the strap of the fastening means includes a slack section between one of the snap fasteners and one end of the strap. In this case, the amount of slack in the slack section is at least equal to the amount the expansion gusset expands when it is moved to its expanded position. In a still further embodiment, the strap includes an elastic section between one of the snap fasteners and one end of the strap, with the elastic section being able to expand an amount at least equal to the expansion distance of the expansion gusset.

In still another embodiment, the expansion gusset is covered on the inside of the case with an elastic member extending all the way around the case to cover the inside of the expansion gusset. In this embodiment, the elastic member covering the expansion gusset can expand an amount at least equal to the expansion distance of the expansion gusset.

Advantageously, as a result of the present invention, the problems of the prior art are avoided, since there are no fixed fasteners to which an undue amount of force is being applied which will eventually weaken and render useless the fixed fastening means. In the present invention, either releasable fastening means are provided, or elastic means are provided, or slack means are provided so that in such cases there is no undue force being applied to the fastening means to release them.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENTS

Figure 1:
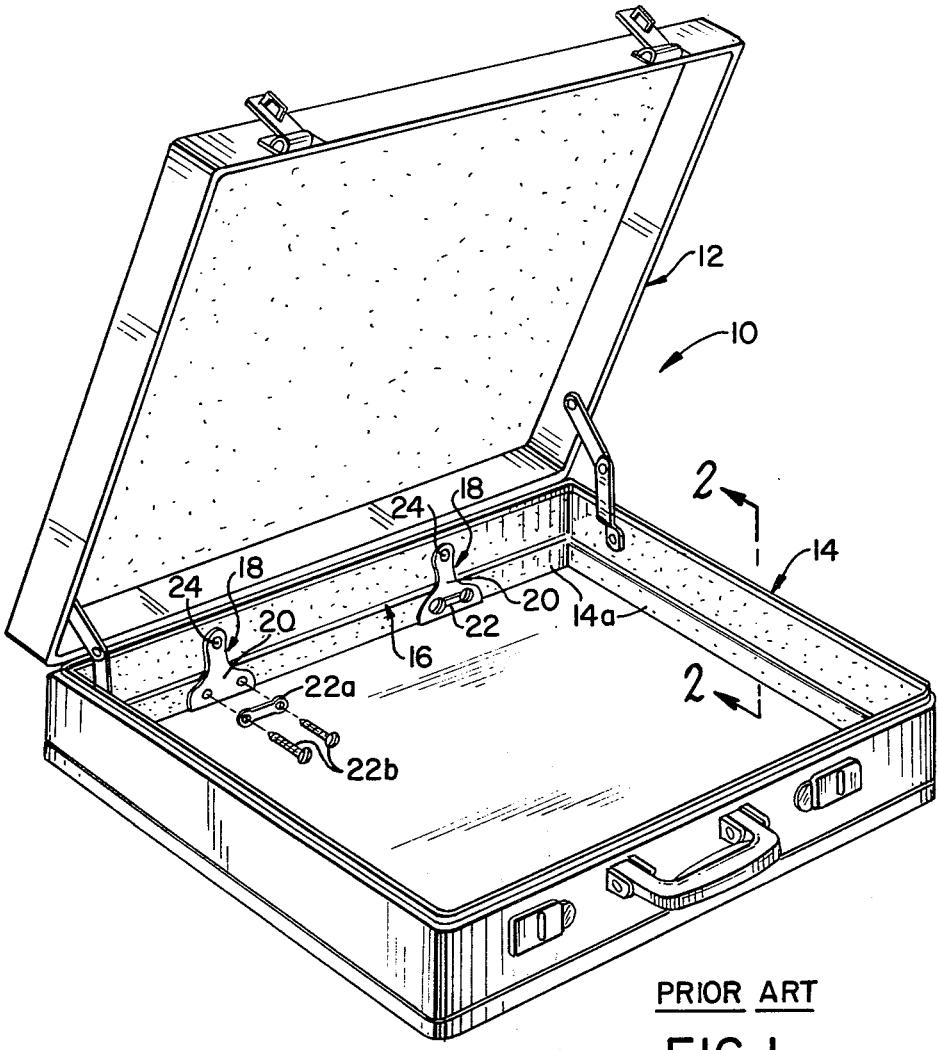
PRIOR ART FIG. 1
FIG. 1 is a perspective view of a prior art attache case including an expansion gusset.
Figure 2:
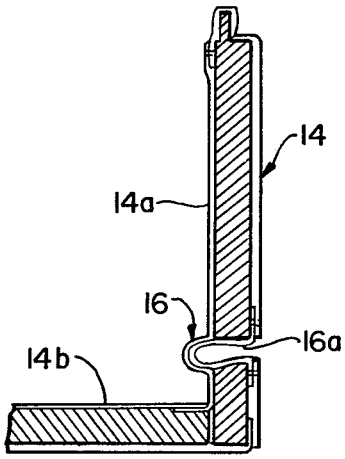
FIG. 2 is a cross section of the case shown in FIG. 1.
Figure 3:
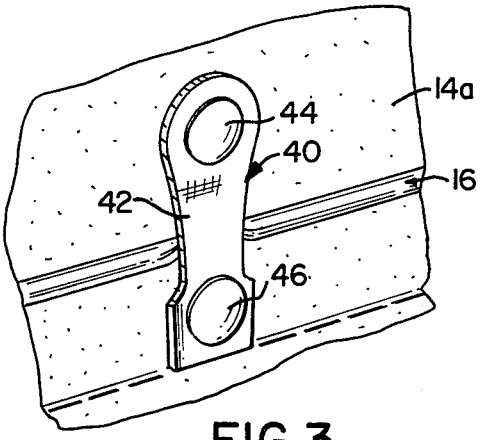
FIG. 3 illustrates the first embodiment of the present invention in which the fastening means includes a strap and two releasable snap fasteners.

Referring to FIG. 3, the first embodiment of the present invention is clearly illustrated. The improved fastening means 40 includes a strap 42 and releasable snap fasteners 44, 46. In this manner, when a force is applied to open the expansion gusset 16, either one or both of the snap fasteners 44, 46 will be released. In addition, as both fasteners are releasable, no damage is caused to the fastening means over a period of time, as shown with the prior art example illustrated in FIG. 1.

Figure 4:
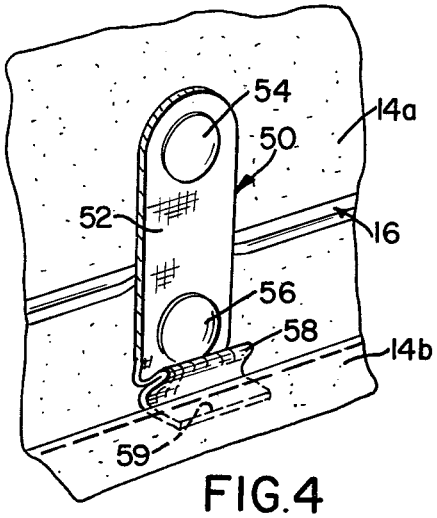
FIG. 4 is a second embodiment of the present invention wherein the fastening means includes a slack section.

With regard to FIG. 4, there is shown another embodiment of a fastening means 50 which includes a strap 52, snap fasteners 54, 56, and a slack section 58. It should be understood that the length of the slack section 58 is at least equal to the length of the expansion gusset 16 in its expanded position. In addition, the lower end of the strap 52 is sewn to the bottom **14*b* of the case underneath the liner as shown at 59**.

Figure 5:
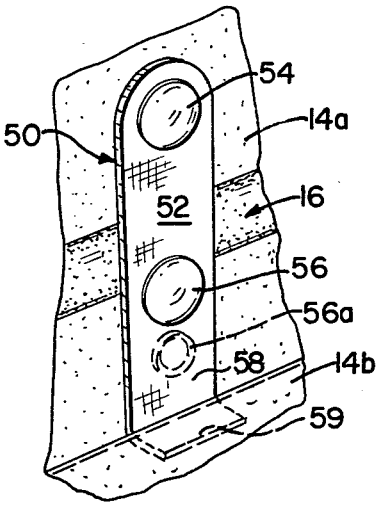
FIG. 5 shows the embodiment of FIG. 4 with the expansion gusset in its expanded position.

The operation of this embodiment is clearly illustrated in FIG. 5. As shown therein, when a force is applied to open the expansion gusset 16, the lower snap fastener 56 will usually release first from snap **56*a*, and the slack 58 will allow for the expansion of the expansion gusset 16. In some cases, the upper snap fastener 54 will also be released. Advantageously, since the lower portion 59 of the strap 52 is sewn to the case, if both fasteners 54, 56 become released, the fastening means 50 does not become completely detached from the case, which might result in a possible loss of the fastening means 50. In addition, in this embodiment, it should be understood that if fastener 56 is released first, an undue force is not applied to the stitched portion 59 of the fastening strap 52 to weaken it because of the operation of the slack section 58**.

Figure 6:
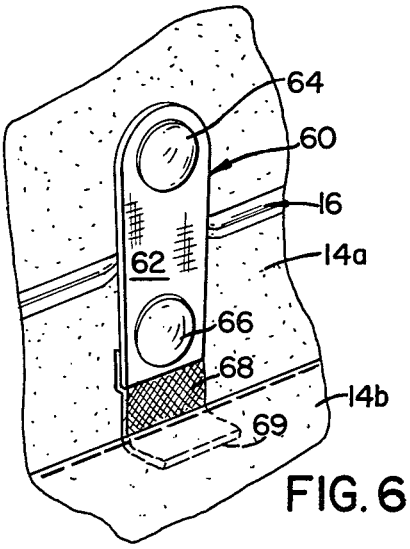
FIG. 6 is a third embodiment of the present invention wherein the fastening means includes an elastic section.

Referring to the embodiment of FIG. 6, there is shown still another embodiment of the present invention, designated as fastening means 60. As shown therein, fastening means 60 includes a strap 62, an upper snap fastener 64, a lower snap fastener 66, an elastic section 68, and a stitched portion 69 under the liner of the case, which can be either elastic or formed from the same material as the strap, such as vinyl or leather.

Figure 7:
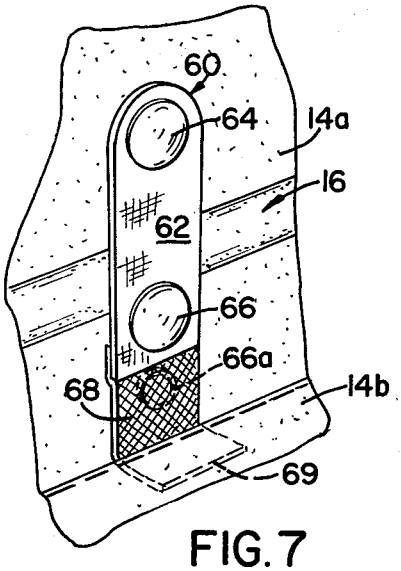
FIG. 7 illustrates the embodiment of FIG. 6 with the expansion gusset in its expanded position.

As shown in FIG. 7, this embodiment operates in a manner similar to that of FIG. 5, except instead of their being a slack section 58, there is an elastic section 68 which has an elasticity at least equal to or greater than the distance which the expansion gusset 16 expands. In this manner, if the lower snap fastener 66 releases first from snap **66*a*, instead of applying an undue force to weaken the stitched section 69, the elastic section 68 immediately expands so no increased force is applied to stitched portion 69 of strap 62** to weaken it.

Figure 8:
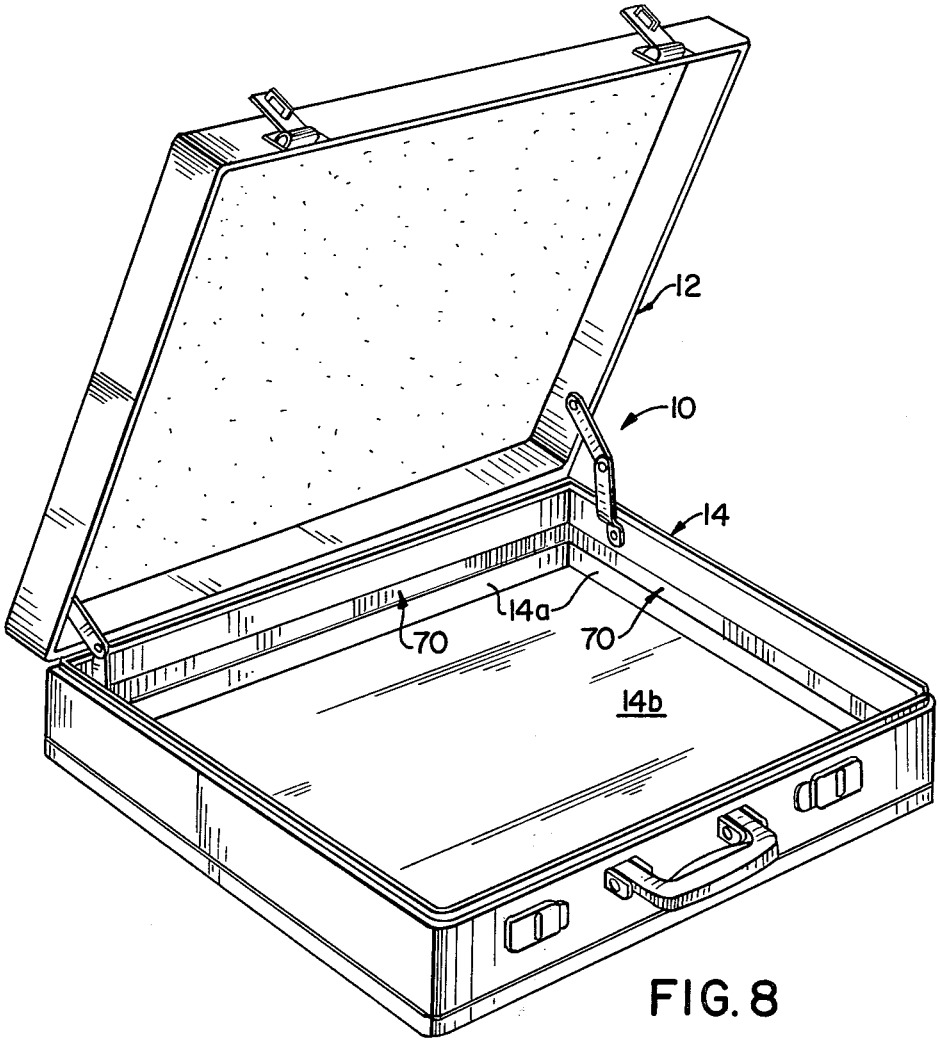
FIG. 8 is a perspective view of a fourth embodiment of the present invention.
Figure 9:
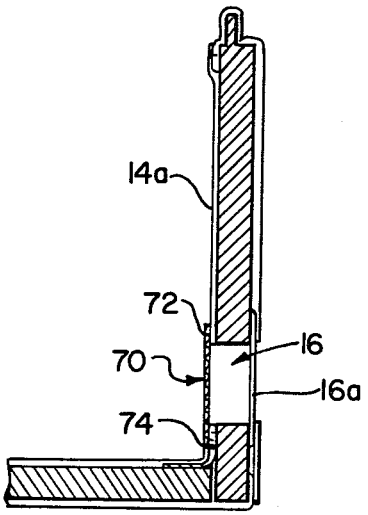
FIG. 9 is a cross-sectional view of FIG. 8 showing the elastic member in its expanded position.

Referring now to FIG. 8, there is shown still another embodiment of the present invention. As shown therein, the fastening means 70 is in the form of an elastic member which overlaps the entire expansion gusset 16 and completely extends all the way around the interior of the attache case. As shown in FIG. 9, it is sewn at its upper end 72 to the liner **14*a* and is sewn at its lower end 74 to the liner. In this manner, when the expansion gusset 16 is moved to its expanded position, the elastic member 70 will gradually expand. As the load in the attache case is decreased, the elastic member 70 gradually contracts and closes the expansion gusset 16 and returns it to its closed position. Of course, the elasticity of member 70 is at least equal to or greater than the expansion distance of gusset 16**.

Figure 10:
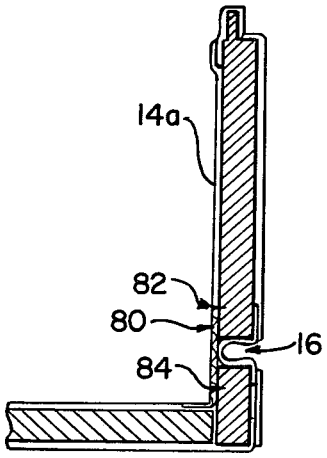
FIG. 10 shows a fifth embodiment of the present invention wherein the elastic expansion member forms a part of the liner of the attache case.

As an alternative to the latter embodiment, another embodiment is shown in FIG. 10, in which the elastic member 80 overlapping the expansion gusset 16 forms a part of the interior liner **14*a* of the attache case and is attached at 82, 84 to the liner. Of course, it should be understood that this embodiment operates in the same manner as the embodiment shown in FIGS. 8 and 9. The present invention also envisions that elastic members 70, 80** can be in the form of elastic straps at various spaced-apart locations around the interior of the case, for example, four such elastic straps.

Advantageously, as a result of the present invention, there has been provided an improved fastening arrangement for the expansion gussets of attache cases which avoids the problems of the prior art in which the fixed end of the fastening means becomes damaged as a result of undue forces applied thereto. As a result of the present invention, an arrangement has been provided which prevents such undue forces from being built up in the fastening means.

A latitude of modification, change, and substitution is intended in the foregoing disclosure, and in some instances, some features of the invention will be employed without a corresponding use of other features. For example, instead of employing snap fasteners, Velcro hooks and loops can be employed. Accordingly, it is appropriate that the appended claims be construed broadly and in a manner consistent with the spirit and scope of the invention herein.

What is claimed is:

1. An attache case, comprising:

first and second sections relatively movable with respect to each other for opening and closing said case;

at least one of said first and second sections including expansion means for expanding the capacity of said case, said expansion means being movable between a closed position and an expanded position;

a plurality of fastening means disposed about said case for releasably maintaining said expanding means in said closed position, each of said fastening means including a strap and a first releasable fastener on a first side of said expansion means and a second releasable fastener on a second side of said expansion means so that at least one of said first and second fasteners of each of said fastening means is released when said expansion means moves to said expanded position.

2. An attache case according to claim 1 wherein said strap includes a slack section between one of said fasteners and one end of said strap.

3. An attache case according to claim 1 wherein said strap includes an elastic section between one of said fasteners and one end of said strap.

4. An attache case according to claims 1, 2, or 3 wherein said first and second releasable fasteners are snap fasteners.

5. An attache case comprising:

first and second sections relatively movable with respect to each other for opening and closing said case;

at least one of said first and second sections including expansion means for expanding the capacity of said case, said expansion means being movable between a closed position and an expanded position;

fastening means for maintaining said expansion means in said closed position, said fastening means including only elastic means connected to both sides of said expansion means and which elastic means extend all the way around the interior of said case and overlaps said expansion means, said elastic means being operative to expand when said expansion means moves to said expanded position.

6. An attache case according to claim 5 wherein said attache case includes a liner on the inside thereof, said liner being discontinuous at said expansion means, and said elastic means overlapping said expanding means and being connected to said liner.

7. An attache case according to claim 5 wherein said attache case includes a liner on the inside thereof, said liner including said elastic means as a portion thereof and overlapping said expansion means, and said elastic means being connected to the ends of said liner.

* * * * *